United States Patent [19]

Imaeda et al.

[11] Patent Number: 4,995,370

[45] Date of Patent: Feb. 26, 1991

[54] LINKED OPERATING DEVICE FOR MULTIPLE CARBURETORS

[75] Inventors: Hirofumi Imaeda; Kyoji Hakamata, both of Hamamatsu, Japan

[73] Assignee: Sanshin Kogyo Kabushika Kaisha, Hamamatsu, Japan

[21] Appl. No.: 483,102

[22] Filed: Feb. 22, 1990

[30] Foreign Application Priority Data

Feb. 23, 1989 [JP] Japan ..... 1-43988

[51] Int. Cl.[5] ..... F02B 13/00

[52] U.S. Cl. ..... 123/583; 261/41.3; 261/23.2

[58] Field of Search ..... 123/584, 583; 261/41.3, 261/23.2

[56] References Cited

U.S. PATENT DOCUMENTS 4,073,278 2/1978 Glenn ..... 26 X/23.2

4,397,792 8/1983 Usui et al. ..... 261/23.2

*Primary Examiner*—E. Rollins Cross

*Attorney, Agent, or Firm*—Ernest A. Beutler

[57] ABSTRACT

A synchronizing mechanism for synchronizing a plurality of throttle valves that employs a single coupling member that couples slave butterfly valves to a directly operated butterfly valve for synchronizing all of the butterfly valves simultaneously.

5 Claims, 2 Drawing Sheets

LINKED OPERATING DEVICE FOR MULTIPLE CARBURETORS

BACKGROUND OF THE INVENTION

This invention relates to a linked operating device for multiple carburetors and more particularly to an improved synchronized system for multiple butterfly type valves of an engine induction system.

In many forms of engine induction systems there are employed a plurality of butterfly type valves that are designed so as to be operated in synchronism. It is important, however, with such constructions to insure that the butterfly type valves all move at the same time and at the same rate. Also, it is important that the valves be at the same angular position in their respective induction system. For example, with throttle valves for either carburetors or fuel injection systems, the throttle valves should all be held in their idle position at the same time. Also, the throttle valve should be opened at the same rate. The same is true with respect to choke valves in engine induction systems.

A wide variety of arrangements have been proposed for synchronizing the movement of such butterfly type valves. For example, in one such system, a lever is affixed to each of the butterfly valve shafts. These levers are then interconnected by means of an adjustable linkage system. The disadvantage with this type of system is that each linkage must be independently adjusted and adjustment of one of them can upset the adjustment of the others.

Another type of arrangement employs a pair of levers for each butterfly valve shaft, one of which is affixed directly to the shaft and the other of which is pivotal relative to it. A biasing spring arrangement is incorporated between the levers and a locking mechanism is incorporated for locking the levers in their adjusted positions. The disadvantage with this type of system is that it considerably complicates the linkage system and does not lend itself easily to synchronizing more than two butterfly type of valves.

It is, therefore, a principal object of this invention to provide an improved arrangement for synchronizing the movement of multiple butterfly type valves for an engine induction system.

It is a further object of this invention to provide an improved and simplified linkage arrangement for interconnecting multiple butterfly valves and achieving their synchronization.

It is a yet further object of this invention to provide an improved and simplified arrangement for synchronizing the movement of multiple butterfly valves through the use of a single synchronizing member.

SUMMARY OF THE INVENTION

This invention is adapted to be embodied in a synchronizing mechanism for synchronizing the operation of a plurality of butterfly valves operated by a single operator for the induction system of an engine. Means are provided for directly coupling the operator to one of the butterfly valves An operating member is affixed to the one butterfly valve for movement therewith and is coupled to a coupling member for movement of the coupling member. A rod is coupled to the other of the throttle valves and is slidable relative to the coupling member. Biasing means are interposed between the rod and the coupling member for urging the rod relative to the coupling member. Means are provided for clamping the rod to the coupling member once synchronization has been achieved.

DETAILED DESCRIPTION OF THE PREFERRED EMBODIMENT OF THE INVENTION

Figure 1:
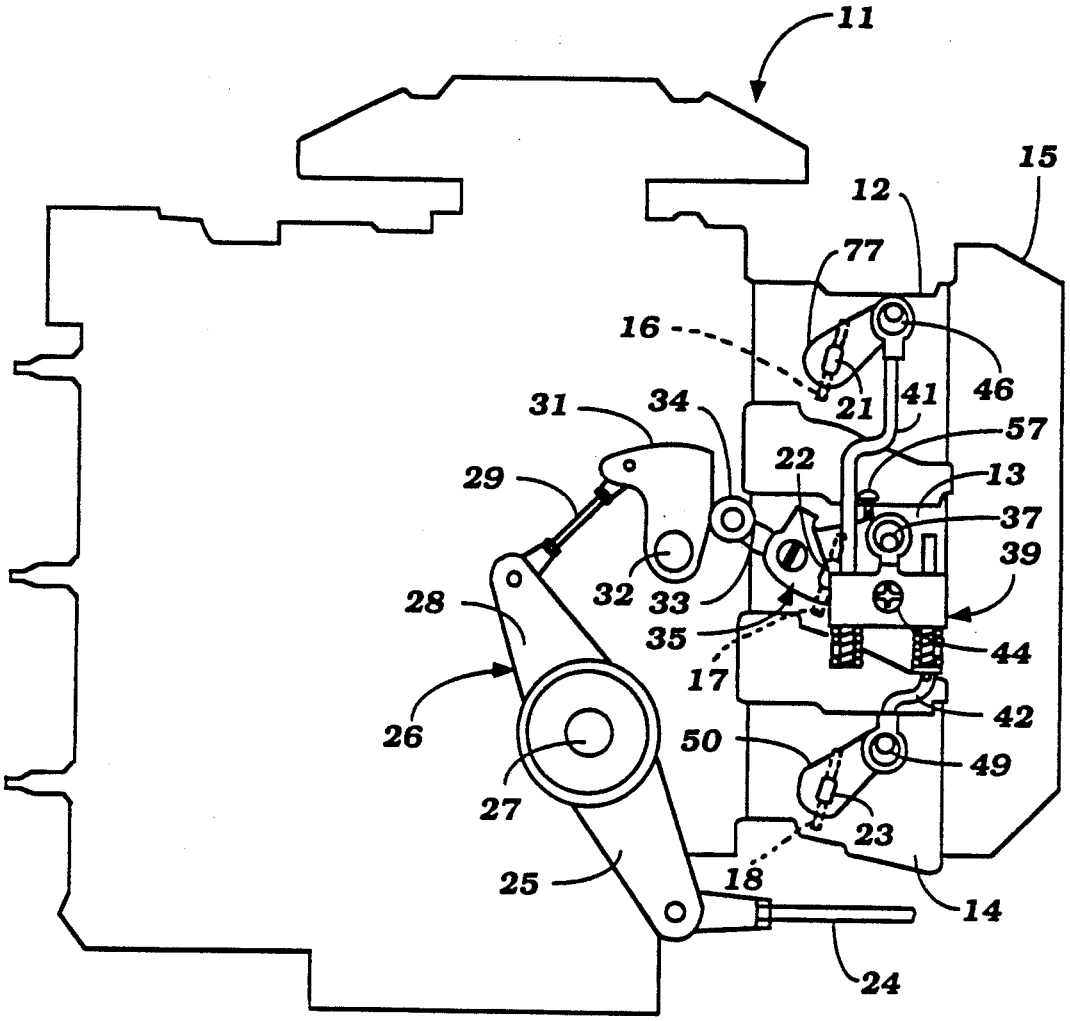
FIG. 1 is a side elevational view of an internal combustion engine constructed in accordance with an embodiment of the invention.

Referring in detail to the drawings and initially to FIG. 1, an internal combustion engine of the three cylinder in line two cycle crankcase compression type embodying the invention is identified generally by the reference numeral 11. The invention is described in conjunction with such engines inasmuch as they normally have multiple intake passages and multiple butterfly type valves for controlling the flow through these intake passages. Also, in the depicted embodiment, the engine 11 is constructed and arranged as utilized in conjunction with an outboard motor since such engines are frequently employed as the power source for an outboard motor. Of course, it is to be understood that the invention is capable of use in other engine applications.

In accordance with conventional two cycle engine practice, there are provided individual carburetors 12, 13 and 14, each of which supplies a fuel/air charge to a respective crankcase chamber of the engine. Since the engine 11 is disposed so that its output shaft rotates about a vertically extending axis, the carburetors 12, 13 and 14 are disposed so that the axes of their induction passages lie in horizontally extending planes, all of which axes are also contained within a common vertically extending plane. An air silencer device 15 supplies air to the carburetors 12, 13 and 14.

Since the invention relates to the arrangement for synchronizing throttle valves 16, 17 and 18 in the induction passages of the respective carburetors 12, 13 and 14 and since the other portions of the construction of the carburetors are irrelevant to the invention, only the throttle valve mechanism and linkage associated with it has been depicted Although the invention is described in conjunction with throttle valves for carburetors, it should be readily apparent that it can be employed with the throttle valves for a fuel injection system or choke valves of the carburetors. Basically, the invention has utility in synchronizing a plurality of butterfly type of valves regardless of their operation and the components associated therewith. Of course, the invention has particular utility in engine induction systems since, as has been noted, such systems normally employ plural butterfly type valves.

The throttle valves 16, 17 and 18 are rotatably journaled within the induction passages of the carburetors 12, 13 and 14 by means of throttle valve shafts 21, 22 and 23 that are journaled within the body of the carburetors 12, 13 and 14 in a known manner.

A remotely positioned operator (not shown) is provided for operating the throttle valves 16, 17 and 18.

This remotely positioned operator operates a link or bowden wire cable 24 that is connected to one arm 25 of a throttle control lever assembly, indicated generally by the reference numeral 26. The throttle control lever assembly 26 is pivotally supported on the engine 11 by means of a pivot shaft 27. Another arm 28 of the throttle control lever assembly 26 is connected by means of an adjustable link 29 to an actuating cam 31 which is journaled for rotation about an axis parallel to the axis defined by the pivot pin 27 by a further pivot pin 32.

A lever 33 is affixed for rotation with one of the throttle valve shafts 21, 22 and 23. In this embodiment, the lever 33 is affixed for rotation with the throttle valve shaft 22 of the center carburetor 13. Of course, other arrangements are possible. The lever 33 carries a roller follower 34 at one end which is engaged with the throttle actuating cam 31 for rotating the lever 33, throttle valve shaft 22 and throttle valve 17 to control the flow of air through the carburetor 13.

Figure 2:
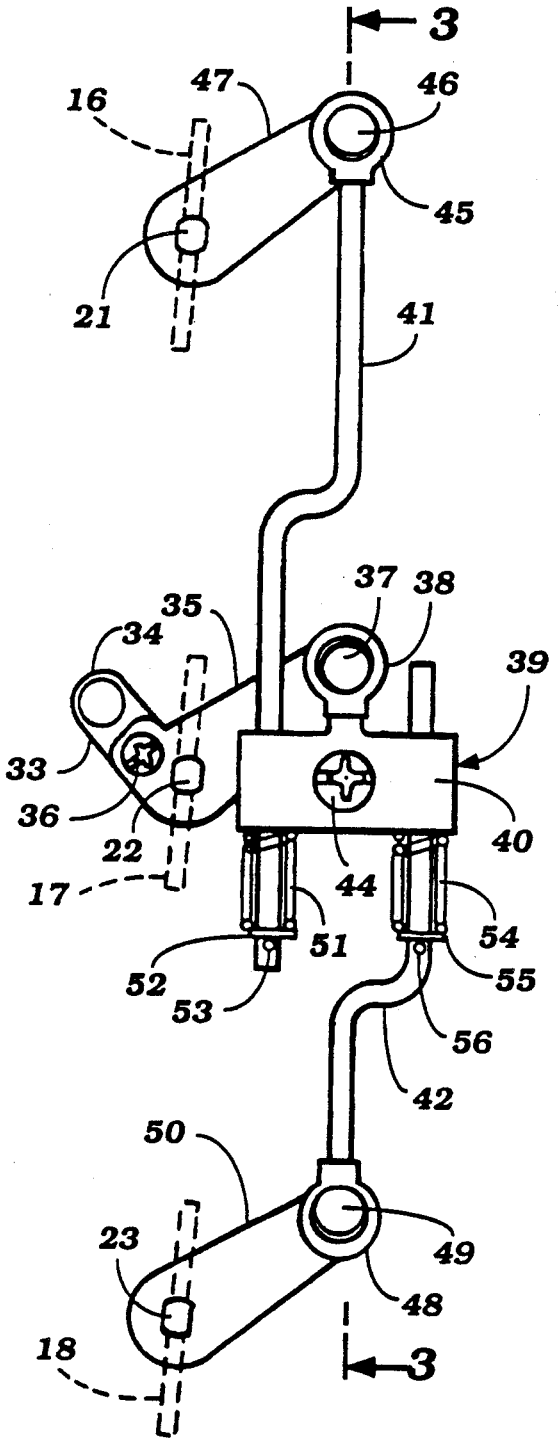
FIG. 2 is an enlarged side elevational view of the throttle valve actuating mechanism and the associated synchronizing mechanism.
Figure 3:
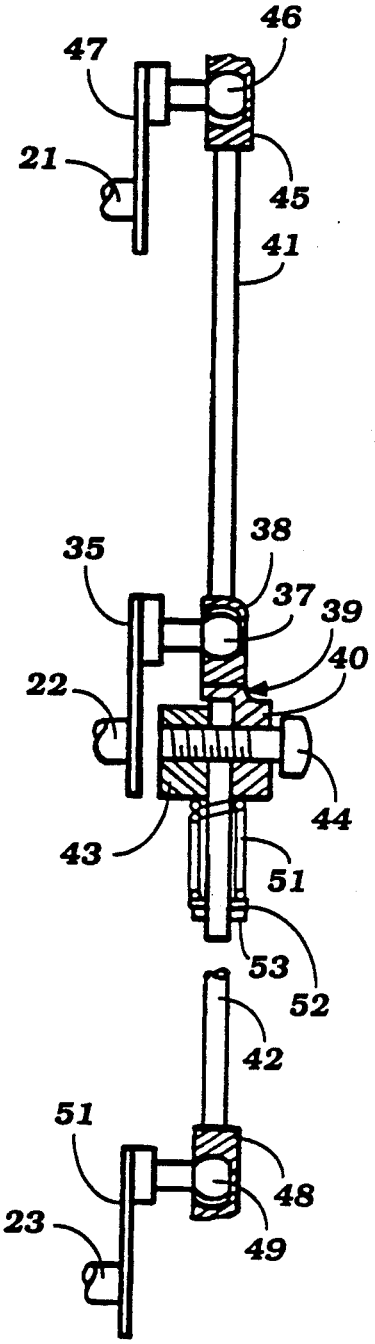
FIG. 3 is a cross sectional view taken along the line 3—3 of FIG. 2.

Referring now primarily to FIGS. 2 and 3, a linkage and synchronizing assembly is provided for interconnecting the throttle valve shaft 22 with the throttle valve shafts 21 and 23 of the remaining carburetors 12 and 14. This mechanism is comprised of an operating lever 35 that is affixed for rotation with the lever 33 about the pivot axis of the throttle valve shaft 22 by means including a screw 36. The operating lever 35 carries a spherical joint 37 at its opposite end which is received within an eyelet 38 of a connecting member, indicated generally by the reference numeral 39.

The connecting member 39 has a base or central portion 40 that defines a pair of grooves which cooperate with rods 41 and 42 for synchronizing the motion of the throttle valves 16, 17 and 18 and for fixing them in synchronized relationship. For this purpose, there is further provided a clamping member 43 that is provided with corresponding grooves for the rods 41 and 42 and which is locked in place by a set screw 44 once synchronization has been achieved, in the manner to be described.

The rod 41 has affixed to its upper end an eyelet 45 that has a connection to a spherical member 46 which is, in turn, carried at the end of a lever 47 that is connected to the throttle valve shaft 21. In a similar manner, the rod 42 has an eyelet 48 that receives a spherical member 49 that is affixed to the end of a lever 50. The lever 50 is, in turn, affixed for rotation with the throttle valve shaft 23.

A first biasing arrangement, comprised of a biasing spring 51, reaction plate 52 and cotter key 53, operates between the coupling member 39 and the rod 41 for urging the rod 41 in a direction that will take up the clearance in the connection between the spherical member 46 and the eyelet 45. In a similar manner, a biasing spring 54, washer 55 and cotter key 56 act on the rod 42 and coupling member 39 so as to take up the clearance in the connection between the spherical member 49 and the eyelet 48. Therefore, to synchronize the carburetors, the screw 44 is released when the throttle valve 17 is in its idle position as set by an idle adjusting screw 57 (FIG. 1) and the springs 51 and 54 will then act to take up the clearance in the system. Once the clearance has been taken up, the screw 44 is tightened and the carburetors will be synchronized.

It should be noted that the springs 51 and 54 are considerably weaker than the return springs associated with the carburetor throttle valves so that they will not tend to open the throttle valves but rather achieve the aforenoted synchronization.

It should be readily apparent that the described mechanism is highly useful in insuring synchronization of multiple butterfly type valves. A single coupling member and adjusting screw can be employed for achieving all of the adjustments.

The foregoing is a description of a preferred embodiment of the invention. Various changes and modifications may be made without departing from the spirit and scope of the invention, as defined by the appended claims.

We claim:

1. A synchronizing mechanism for synchronizing the operation of a plurality of butterfly valves operated by a single operator for the induction system of an engine comprising means for directly coupling said operator to one of said butterfly valves, an operating member affixed to said one butterfly valve for movement therewith, a coupling member coupled for movement with said operating member, a rod coupled to the other of said throttle valves and slidable relative to said coupling member, biasing means interposed between said rod and said coupling member for urging said rod relative to said coupling member and means for clamping said rod to said coupling member.

2. A synchronizing mechanism as set forth in claim 1 wherein the biasing means acts to urge the one butterfly valve against a fixed stop and the other butterfly valve against a return spring, the return spring having a stronger force than the biasing means.

3. A synchronizing mechanism as set forth in claim 1 wherein there are a plurality of synchronized butterfly valves including a third butterfly valve, a second rod coupled to the said third butterfly valve and slidable relative to the coupling member, second biasing means interposed between said second rod and said coupling member for urging said second rod relative to said coupling member and means for clamping said second rod to said coupling member.

4. A synchronizing mechanism as set forth in claim 3 wherein the clamping means for clamping both of the rods to the coupling member comprises a single clamping means.

5. A synchronizing mechanism as set forth in claim 4 wherein the coupling member is a split member, the pieces of which define relative grooves for receiving and slidably supporting the rods and wherein the clamping means secure said pieces to each other and affix the coupling member to the rods.

* * * * *